United States Patent [19]

Auriemma

[11] 4,183,696

[45] Jan. 15, 1980

[54] UNDERGROUND DRAINAGE PIPE

[76] Inventor: Robert S. Auriemma, Rte. #1, Box 104, Bethel, Pa. 19507

[21] Appl. No.: 900,509

[22] Filed: Apr. 27, 1978

Related U.S. Application Data

[63] Continuation-in-part of Ser. No. 783,767, Apr. 1, 1977, which is a continuation-in-part of Ser. No. 682,492, May 3, 1976, Pat. No. 4,065,925.

[51] Int. Cl.[2] ..... E02B 11/00

[52] U.S. Cl. ..... 405/43; 405/48

[58] Field of Search ..... 61/10, 11, 12, 13

[56] References Cited

U.S. PATENT DOCUMENTS

| | | | |
|---|---|---|---|
| 460,352 | 9/1891 | Reading | 405/48 |
| 2,782,805 | 2/1957 | Leadbetter | 61/10 |
| 3,333,422 | 8/1967 | Neyland | 405/48 |
| 3,681,925 | 8/1972 | Schmunk et al. | 405/49 |
| 4,065,925 | 1/1978 | Auriemma | 405/47 |
| 4,102,135 | 7/1978 | Auriemma | 61/10 |

FOREIGN PATENT DOCUMENTS

| | | | |
|---|---|---|---|
| 234055 | 6/1964 | Austria | 61/10 |
| 836337 | 1/1939 | France | 61/10 |
| 511677 | 8/1939 | United Kingdom | 61/11 |

*Primary Examiner*—David H. Corbin
*Attorney, Agent, or Firm*—Thomas Hooker

[57] ABSTRACT

An improved underground drainage pipe formed of an extruded stiffly flexible plastic member having a trough with spaced upstanding lips and an integral overlying roof with triangular shaped drainage openings formed through the lips at regular intervals along the length of the pipe. When buried, the drainage openings resist clogging by gravel or pebbles in the surrounding soil thereby improving the drainage capability of the pipe. The thickness of the trough increases from the center point to the lips thereby compensating for the drainage openings and enabling the pipe to withstand vertical loading forces.

5 Claims, 4 Drawing Figures

Fig. 1
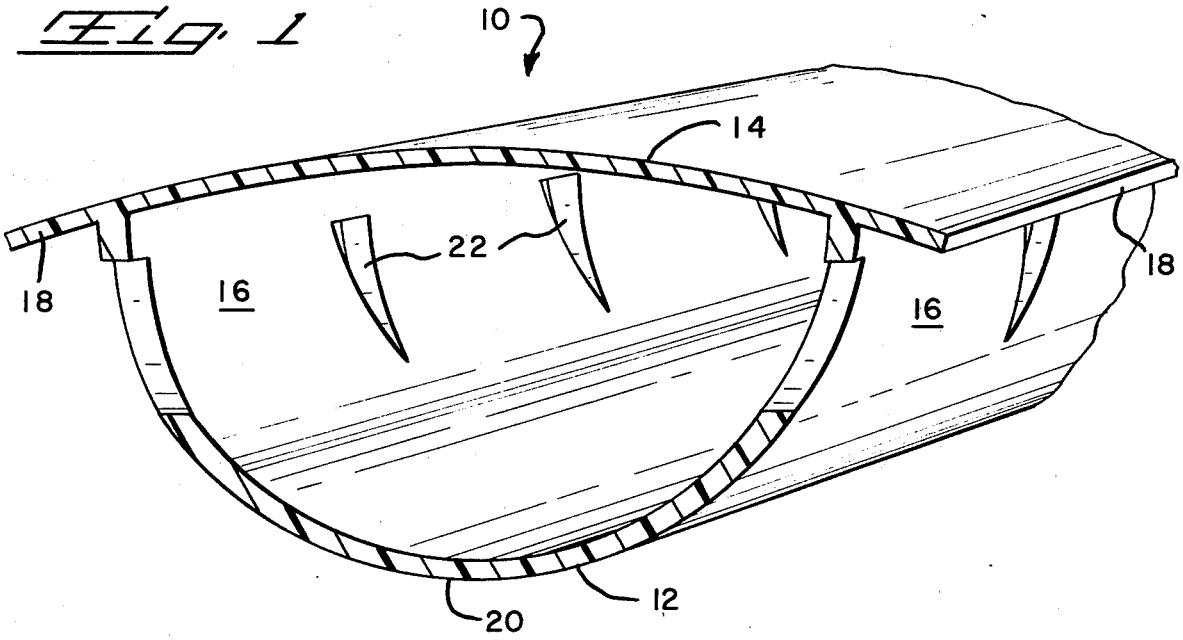
Fig. 2
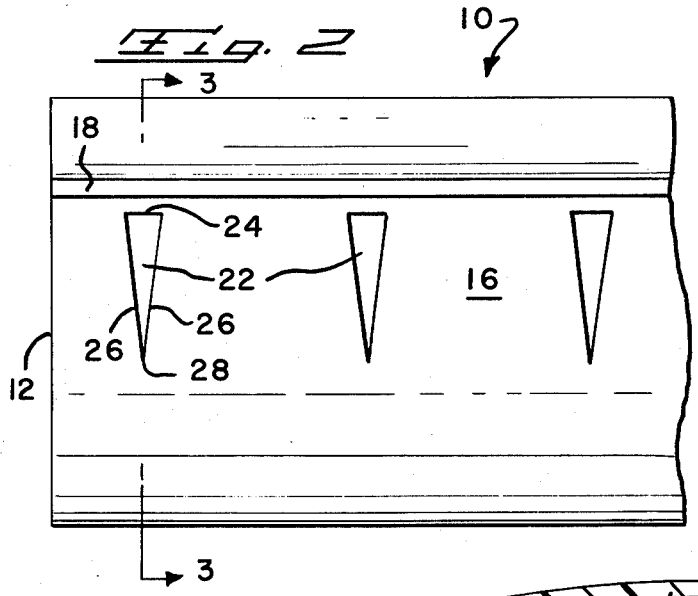
Fig. 3
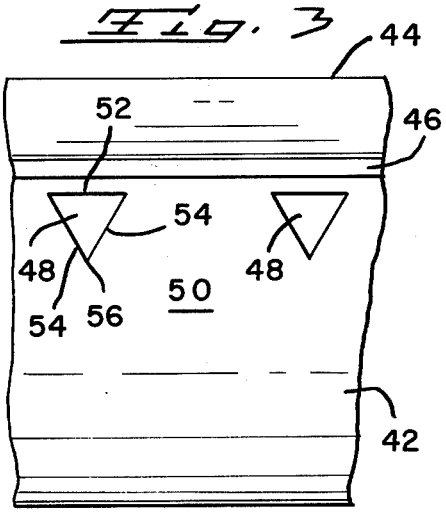
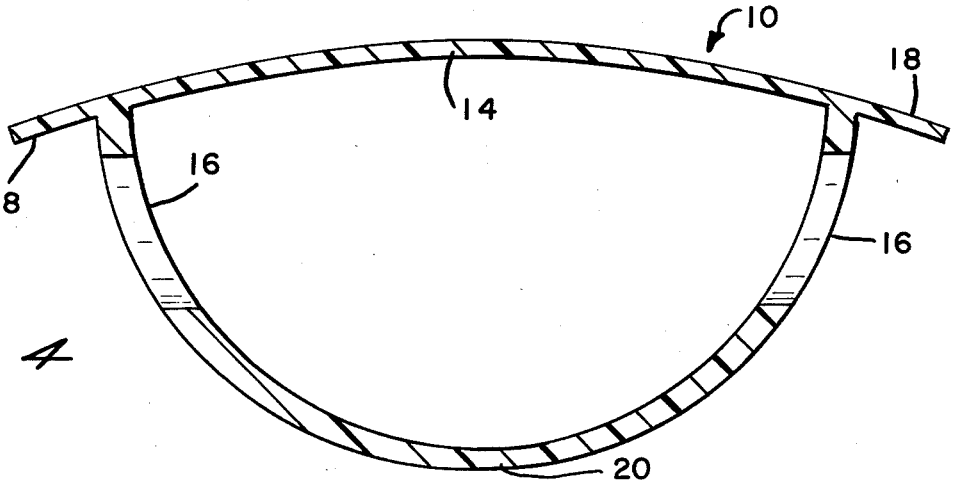
Fig. 4

UNDERGROUND DRAINAGE PIPE

This application is a continuation-in-part of my co-pending application Ser. No. 783,767 filed Apr. 1, 1977 which is a continuation in part of my co-pending application Ser. No. 682,492 filed May 3, 1976, which issued on Jan. 3, 1978 as U.S. Pat. No. 4,065,925.

The invention relates to underground plastic drainage pipes of the type buried along the soil to remove excess ground water from the soil. A conventional pipe of this type is disclosed in U.S. Pat. No. 3,333,422. This patent discloses a pipe having a U-shaped trough with an overlying roof and circular drainage openings extending through the trough lips for removing ground water. Protective wings extend over the drainage opening so that when the pipe is buried in a ditch the soil is not forced up against the openings. In practice, the flow of ground water from the soil into the drainage openings draws particulate matter in the soil toward the openings with the result that, in time, pebbles larger than the openings are drawn against them and partially or completely close the openings to restrict the drainage capacity of the pipe. This is a serious defect since the only remedy is to dig up the pipe and then rebury it. This procedure is difficult and expensive.

The drain pipe of the present invention is similar to the conventional drain pipes but uses an improved drainage opening having two adjacent essentially straight walls which intersect at an acute angle so that the width of the opening increases away from the point of intersection. The drainage openings may be a triangular in shape and are preferably located in the lip portion of the trough beneath the wings with the acute angle defining the low point of the opening. With this type of drainage opening it is unlikely that one or a number of cubical stone fragments or pebbles can clog the opening or materially decrease its flow capacity. The thickness of the trough preferably increases from the bottom of the openings to the tops of the openings to add strength to the pipe and compensate for the openings in the lips.

Other objects and features of the invention will become apparent as the description proceeds, especially when taken in conjunction with the accompanying drawings illustrating the invention, of which there is one sheet.

IN THE DRAWING

FIG. 1 is a sectional view in perspective illustrating a drainage pipe according to the invention;

FIG. 2 is a side view of the pipe shown in FIG. 1;

FIG. 3 is a sectional view taken along line 3—3 of FIG. 2; and

FIG. 4 is a side view of a different embodiment of the invention.

Referring now to FIGS. 1, 2, and 3, underground drainage pipe 10 is formed from an indefinite length of extruded stiffly flexible plastic having a U-shaped trough 12 with an integral roof 14 overlying the trough and extending outwardly beyond trough lips 16 to form protective wings 18. Roof 14 has a uniform thickness between lips 16 and trough 12 has a minimum thickness at circumferencial midpoint 20 located at the bottom of the trough. The trough thickness smoothly and gradually increases to either side of the midpoint 20 to a maximum thickness at the top of the lips where the trough joins the roof.

A series of triangularly shaped drainage openings 22 are formed through the thickness of the lips 16 along the length of the pipe. As illustrated in FIG. 2, the openings form triangular outlines on the outer surface of lips, each opening having a short side 24 and a pair of long major sides 26. The short side is located adjacent the protective wing 18 and extends parallel to the length of the pipe. The long sides extend from the ends of the short side around the circumference of the trough to an apex or point of intersection 28 located at the bottom of the opening. Sides 26 are approximately four times longer than side 24 so that they intersect at an angle of approximately 15°.

Pipe 10 is intended to be buried in soil for the purpose of removing excess ground water from the soil. The water flows into the pipe through openings 22 and is carried away along the length of the pipe to a suitable point of discharge. The wings 18 extend outwardly above the drainage openings 22 to prevent surrounding soil from being packed hard against the openings and clogging them. Conventional underground drainage pipes use drainage openings of circular or rectangular shape. These types of openings are clogged easily by surrounding pebbles and particles in the soil which are easily drawn against them during drainage. In practice, the pebbles can severely restrict drainage flow through the opening and may completely close the openings.

Triangular openings 22 of pipe 10 have improved drainage capabilities over the conventional circular or rectangular openings of conventional pipes. Cubical shaped stone fragments or pebbles can not completely seal against the openings due to their V-shape where the width of the opening increases from the intersecting low point 28 to a maximum width at side 24. The maximum width of the opening is located under the wing so that the wing provides maximum protection for it and decreases the chances that pebbles will be drawn to this wide portion of the opening. The openings 22 are tapered and relatively long in comparison with their width thereby decreasing the chance that a single pebble could block the entire opening.

Frequently buried pipe 10 is subjected to substantial vertical loading forces which may, for instance when the soil surrounding the pipe is saturated with water, be sufficient to deform the pipe. The increased thickness of trough 12 to either side of midpoint 20 aids in distributing stresses around the circumference of the trough to increase the ability of pipe 10 to withstand and recover from loading forces without fracturing of the pipe. Because the relatively narrow triangular drainage openings 22 are tapered in width and extend around the circumference of the trough they have a minimum effect on the trough strength in the lip area when the pipe is subjected to vertical loading. The increase in thickness of the lips from the bottom to the top of the openings strengthens the lips to compensate for the slight loss in strength due to the material removed to form the drainage openings. The thickness of the lips increases smoothly and gradually from the apex 28 to side 24 so that there is a smooth and gradual distribution of loading stresses around the circumference of the trough.

Openings 22 may be formed through lips 18 by any conventional technique. While FIGS. 1 through 3 show that the openings have sharp angles at the intersections of adjacent sides, in production, these intersections may be rounded and the sides of the triangular drainage openings may not be perfectly straight.

FIG. 3 illustrates a second embodiment of the invention wherein pipe 40 includes a trough 42 and roof 44 with wings 46 identical to the corresponding trough, roof and wings of pipe 10. Equalaterally shaped triangular drainage openings 48 are formed through both lips 50 of pipe 40 at spaced intervals along the length of the pipe. As illustrated, the upper side 52 of each opening extends along the length of the pipe and is located adjacent to the overlying wing. The other sides 54 extend downwardly from side 52 to low point 56. The adjacent sides of the drainage openings 48 diverge from each other at 60° angles. This divergance is greater than the angle of divergance between sides 26 of drainage openings 22 and is desirable in preventing clogging of the openings when pipe 40 is buried in soil having a large percent of cubically shaped stones or pebbles.

While I have illustrated and described preferred embodiment of my invention, it is understood that this is capable of modification, and I therefore do not wish to be limited to the precise details set forth, but desire to avail myself of such changes and alterations as fall within the purview of the following claims.

What I claim my invention is:

1. A drainage pipe adapted to be buried underground and having improved drainage and strength characteristics, said pipe formed of a length of extruded stiffly flexible plastic including a generally U-shaped trough opening upwardly with lips at the upper trough edges; a roof overlying the trough and integrally joining the trough at the top of the lips, a series of generally triangular drainage openings formed at regular intervals through the thickness of each lip, each opening having a pair of long sides extending along the outer surface of the trough to a point of intersection away from the lip and a short side extending along the length of the pipe and joining the upper ends of the long sides adjacent the upper trough edge, said long sides intersecting at an acute angle whereby upon burial of the pipe in pebbly soil the soil filling around the trough may partially but not completely block said openings, the thickness of said lips increasing smoothly from the bottom of the drainage openings to the roof to strengthen the trough and compensate for loss of strength due to the drainage openings.

2. A drainage pipe as in claim 1 wherein each long side is about four times longer than the short side and the long sides intersect at an angle of about 15°.

3. In an underground drainage pipe of the type formed of a length of extruded stiffly flexible plastic material and including a generally U-shaped trough opening upwardly with lips at the upper trough edges; a roof overlying the trough and integrally joining the trough at said trough edges, and a series of generally triangular drainage openings extending through the trough thickness at regular longitudinally spaced intervals along the length of each lip, the improvement comprising each opening having a short side and pair of long sides, said long sides extending away from the lip and around the circumference of the trough and intersecting at a point located below and inwardly of the short side of the opening, the short side extending along the length of the pipe and joining the upper ends of the two long sides, said long sides intersecting at an acute angle to form a V-shaped part of the opening away from the point of intersection whereby upon burial of the pipe in pebbly soil the V-shaped parts of the openings prevent complete blockage by generally round pebbles; and the thickness of said lips increasing smoothly from the bottom of the drainage openings to the top of the lips to strengthen the lips and, at least in part, compensate for loss of trough strength due to the drainage openings.

4. A drainage pipe as in claim 3 wherein long side of each drainage opening is about four times longer than the short side.

5. The drainage pipe as in claim 3 wherein the long sides intersect at an angle of about 15°.

* * * * *

UNITED STATES PATENT OFFICE

CERTIFICATE OF CORRECTION

PATENT NO. : 4,183,696

DATED : January 15, 1980

INVENTOR(S) : Robert S. Auriemma

It is certified that error appears in the above-identified patent and that said Letters Patent are hereby corrected as shown below:

Front page, Item [45] should include the following:

Term subsequent to July 25, 1995, has been disclaimed.

Signed and Sealed this

*First* Day of *April 1980*

[SEAL]

*Attest:*

SIDNEY A. DIAMOND

*Attesting Officer*

*Commissioner of Patents and Trademarks*